United States Patent [19]

Gillich

[11] Patent Number: 4,778,616

[45] Date of Patent: Oct. 18, 1988

[54] SCRATCH CORRECTOR FOR LITHOGRAPHIC PRINTING PLATES

[75] Inventor: Thomas N. Gillich, Whitehouse Station, N.J.

[73] Assignee: Hoechst Celanese Corporation, Somerville, N.J.

[21] Appl. No.: 56,180

[22] Filed: Jun. 1, 1987

[51] Int. Cl.[4] ..... C11D 3/04; C11D 1/02; B41F 35/00

[52] U.S. Cl. ..... 252/135; 252/174.16; 252/DIG. 17; 101/424

[58] Field of Search ..... 101/424; 252/135, 174.16, 252/DIG. 17

[56] References Cited

U.S. PATENT DOCUMENTS

| | | | |
|---|---|---|---|
| 3,394,653 | 7/1968 | Riesberg | 101/465 |
| 3,462,520 | 8/1969 | Nehmsmann et al. | 252/174.16 |
| 3,679,479 | 7/1972 | Ray et al. | 101/466 |
| 3,882,038 | 5/1975 | Clayton et al. | 252/164 |
| 3,887,497 | 6/1975 | Ulvild | 252/526 |
| 4,028,281 | 6/1977 | Millard et al. | 252/527 |
| 4,162,920 | 7/1979 | Gillich | 101/465 |
| 4,504,406 | 3/1985 | Dhillon | 252/143 |
| 4,539,134 | 9/1985 | Martin et al. | 252/DIG. 17 |
| 4,576,743 | 3/1986 | Kita et al. | 252/524 |
| 4,664,721 | 5/1987 | Valasek | 101/424 |

OTHER PUBLICATIONS

Literature from Milliken Chemicals on Synfac 8337 and other Synfac Products.

*Primary Examiner*—Paul Lieberman
*Assistant Examiner*—Helene Kirschner
*Attorney, Agent, or Firm*—Richard S. Roberts

[57] ABSTRACT

A composition for correcting scratches on the non-image areas of a metal based lithographic printing plate which contains trisodium phosphate, sodium metasilicate, an anionic surfactant and water.

16 Claims, No Drawings

SCRATCH CORRECTOR FOR LITHOGRAPHIC PRINTING PLATES

BACKGROUND OF THE INVENTION

The present invention relates to lithographic printing plates or more particularly to a composition suitable for correcting the surface a metal based lithographic printing plate which has become scratched due to handling.

Lithographic is a printing system taking advantage of the natural mutual repulsion between water and oils. The surface of a lithographic printing plate comprises areas which accept water and repel an oily ink, and areas which repel water and accept an oily ink. The former areas constitute non-image areas, and the latter areas constitute image areas. Accordingly, if the surface properties between these two areas is disturbed, for example, if the hydrophilic property of the non-image areas is scratched during handling, inks are apt to adhere to such hydrophilicity-deteriorated areas to cause background stains.

Furthermore, when the non-image areas take scratches, the scratches are filled with an ink and are gradually rendered oilsensitive to cause stains.

One method of hydrophilically sensitizing a metal surface, particularly an aluminum surface, is by treating the surface with an aqueous alkali metal silicate solution such as a sodium or potassium meta-silicate solution. Such solutions have also been used to clean smudges, and to remove scratches and faint imperfections such as surface scratches from imaged and developed paper printing plates. Other alkaline salts of a strong base and a weak acid in addition to alkali metal silicates have been used in such solutions (See U.S. Pat. No. 3,394,653). U.S. Pat. No. 4,028,281 teaches a metal plate treating solution including an alkali metal silicate, a surfactant and the ferric chelate of ethylene diamine tetra acetic acid as a cleaning and scratch removing solution for imaged and developed planographic printing plates.

It has now been found that scratches in the background, non-image areas of plates may be corrected, i.e., re-hydrophilized so as not to accept greasy ink in the printing process, with a composition containing trisodium phosphate, sodium metasilicate, an anionic surfactant and water.

SUMMARY OF THE INVENTION

The invention provides a composition for correction scratches on the non-image areas of a metal based lithographic printing plate consisting essentially of from about 0.25% to about 10.0% of a sodium, lithium or potassium tribasic phosphate, and from about 0.25% to about 5.0% sodium metasilicate, and from about 0.10 to about 5.0% of an anionic surfactant which is an aryl phenol ethoxylate and from about 80.0% to about 99.4% water.

The invention also provides a method for correcting scratches on the non-image areas of a metal based lithographic printing plate which comprises: providing an imagewise exposed and developed lithographic printing plate having hydrophilic non-image areas and oleophilic image areas and having at least one scratch in the non-image area thereof; and contacting said scratch with a composition consisting essentially of from about 0.25% to about 10.0% of a sodium, lithium or potassium tribasic phosphate, and from about 0.25% to about 5.0% sodium metasilicate, and from about 0.10 to about 5.0% of an anionic surfactant which is an aryl phenol ethoxylate and from about 80.0% to about 99.4% water.

DETAILED DESCRIPTION OF THE PREFERRED EMBODIMENT

As hereinbefore mentioned, the scratch correction composition of this invention contains a sodium, lithium or potassium tribasic phosphate; sodium metasilicate, an anionic surfactant and water.

The phosphate component is present in an amount ranging from about 0.25% to about 10.0%, perferably about 0.5% to about 5.0% and most preferably from about 1.0% to about 3.0% by weight of the composition. In the most preferred this component is trisodium phosphate. The sodium metasilicate component can range from about 0.25% to about 5.0%, preferably from about 0.5% to about 3.0% and most preferably from about 1.0% to about 2.5% based on the weight of the composition. The anionic surfactant is an aryl phenol alkoxylate and in the preferred embodiment is a potassium salt of phosphated alkoxylated aryl phenol. This component serves to reduce surface tension and facilitate the penetration of the other components into the scratch surface to be corrected. The surfactant is present in an amount of from about 0.10% to about 5.0% based on the weight of the composition. A more preferred range is from about 0.2% to about 3.0% and most preferably from about 0.3% to about 2.0% based on the weight of the composition. The water component is present in an amount of from about 80.0% to about 99.4%, preferably from about 89.0 to about 98.8% and more preferably from about 92.5% to about 97.7% based on the weight of the composition.

The following non-limiting examples serve to illustrate the invention.

EXAMPLE 1

A solution is prepared by adding 22.5 g of sodium metasilicate ($5H_2O$), 30.0 g trisodium phosphate and 10.0 gs of Synfac 8337 (a proprietary blend of anionic aryl phenol alkoxylate and solvents produced by Milliken Chemicals) to 1937.5 g. of soft water. The mixture is stirred for 10 minutes to produce a clear homogeneous solution.

N-250 negative acting lithographic printing plates produced by the Enco Printing Products Division of Hoechst Celanese Corporation are used to evaluate the prepared solution. The N-250 plate is exposed, developed and run on a Heidelberg SORK sheet fed press and provides acceptable quality print. The press is stopped at which time the plate is scratched in four positions across the background surface. This is done to simulate scratch conditions which frequently occur in pressrooms due to handling. The plate surface is observed to accept ink in the areas scratched when printing resumes. The ink is evident on the printed sheet. The press is the stopped. One section scratched is not treated. A second scratch is treated with the solution of this example. The third scratch is first washed with Varn-120 blanket wash and then treated with the solution of this example. The fourth scratch is first treated with FPC (Finisher/Preserver/Cleaner produced and sold by Enco Printing Products Division of Hoechst Celanese Corporation) and then treated with the solution of this example. The printing is continued. The untreated area continues to print where scratched. The three treated areas printed without evidence of a scratched surface. After 5000 impressions the area treated with only the solution of this example showed very slight sensitivity. The other two areas completed the run of 230,000 without further evidence of sensitivity in the treated areas.

Testing shows that scratched areas of the plate background treated only with blanket wash and/or FPC are not effective in preventing scratched areas from printing.

EXAMPLE 2

A product identified as Plate Fix (produced and sold by Allied Photo Supply Corp. Hollywood, Fla.) is likewise tested as described in Example 1. This product is recognized as being useful for correcting scratched background areas on offset lithographic printing plates so that printed matter is free from any printed imperfections. The results show that the untreated portion unacceptably prints where scratched. The area treated only with Plate Fix similarly provides unacceptable print. The portion first cleaned with Van-120 blanket wash prints a light amount of ink where treated. This gets progressively worse as the run continues. The section treated first with FPC and then the Plate Fix provides ink free copies. The run continues for an additional 5000 impressions at which time the scratched area is observed to print.

What is claimed is:

1. A composition for correcting scratches on the non-image areas of a metal based lithographic printing plate consisting essentially of from about 0.25% to about 10.0% of a sodium, lithium or potassium tribasic phosphate, and from about 0.25% to about 5.0% sodium metasilicate, and from about 0.10 to about 5.0% of an anionic surfactant which is an aryl phenol ethoxylate and from about 80.0% to about 99.4% water.

2. The composition of claim 1 wherein said phosphate component is trisodium phosphate.

3. The composition of claim 1 wherein said phosphate component is present in an amount of from about 0.5% to about 5.0% based on the weight of the composition.

4. The composition of claim 1 wherein said sodium metasilicate is present in an amount of from about 0.5% to about 3.0% based on the weight of the composition.

5. The composition of claim 1 wherein said surfactant is a potassium salt of phosphated alkoxylated aryl phenol.

6. The composition of claim 1 wherein said surfactant is present in an amount of from about 0.2% to about 3.0% based on the weight of the composition.

7. The composition of claim 1 wherein said water component is present in an amount of from about 89.0% to about 98.8% based on the weight of the composition.

8. The composition of claim 1 wherein said phosphate component is trisodium phosphate; and wherein said phosphate component is present in an amount of from about 1.0% to about 3.0% based on the weight of the composition; and wherein said sodium metasilicate is present in an amount of from about 1.0% to about 2.5% based on the weight of the composition; and wherein said surfactant is a potassium salt of phosphated alkoxylated aryl phenol; and wherein said surfactant is present in an amount of from about 0.3% to about 2.0% based on the weight of the composition and; wherein said water component is present in an amount of from about 92.5% to about 97.7% based on the weight of the composition.

9. A method for correcting scratches on the non-image areas of a metal based lithographic printing plate which comprises: providing an imagewise exposed and developed lithographic printing plate having hydrophilic non-image areas and oleophilic image areas and having at least one scratch in the non-image area thereof; and contacting said scratch with a composition consisting essentially of from about 0.25% to about 10.0% of a sodium, lithium or potassium tribasic phosphate, and from about 0.25% to about 5.0% sodium metasilicate, and from about 0.10 to about 5.0% of an anionic surfactant which is an aryl phenol ethoxylate and from about 80.0% to about 99.4% water.

10. The method of claim 9 wherein said phosphate component is trisodium phosphate.

11. The method of claim 9 wherein said phosphate component is present in an amount of from about 0.5% to about 5.0% based on the weight of the composition.

12. The method of claim 9 wherein said sodium metasilicate is present in an amount of from about 0.5% to about 3.0% based on the weight of the composition.

13. The method of claim 9 wherein said surfactant is a potassium salt of phosphated alkoxylated aryl phenol.

14. The method of claim 9 wherein said surfactant is present in an amount of from about 0.2% to about 3.0% based on the weight of the composition.

15. The method of claim 9 wherein said water component is present in an amount of from about 89.0% to about 98.8% based on the weight of the composition.

16. The method of claim 9 wherein said phosphate component is trisodium phosphate; and wherein said phosphate component is present in an amount of from about 1.0% to about 3.0% based on the weight of the composition; and wherein said sodium metasilicate is present in an amount of from about 1.0% to about 2.5% based on the weight of the composition; and wherein said surfactant is a potassium salt of phosphated alkoxylated aryl phenol; and wherein said surfactant is present in an amount of from about 0.3% to about 2.0% based on the weight of the composition and; wherein said water component is present in an amount of from about 92.5% to about 97.7% based on the weight of the composition.

* * * * *